US006105763A

United States Patent [19]

Saetia

[11] Patent Number: 6,105,763

[45] Date of Patent: Aug. 22, 2000

[54] MULTIPLE-ACCESS COMPUTER AND CATALOG CARRYING CASE

[76] Inventor: Chetta Saetia, 1235 White Oak Dr., Apt 1636, Waukegan, Ill. 60085

[21] Appl. No.: 09/231,475

[22] Filed: Jan. 14, 1999

Related U.S. Application Data

[60] Provisional application No. 60/083,734, May 1, 1998.

[51] Int. Cl.[7] ..... B65D 85/38

[52] U.S. Cl. ..... 206/320; 190/102; 190/109

[58] Field of Search ..... 206/320; 190/102, 190/109, 110, 111, 114, 106

[56] References Cited

U.S. PATENT DOCUMENTS

| | | | |
|---|---|---|---|
| 5,086,888 | 2/1992 | Chu | 190/170 |
| 5,160,001 | 11/1992 | Marceau | 190/102 |
| 5,217,119 | 6/1993 | Hollingsworth | 206/320 |
| 5,242,056 | 9/1993 | Zia et al. | 190/110 |
| 5,265,719 | 11/1993 | Wand | 206/223 |
| 5,437,367 | 8/1995 | Martin | 206/320 |
| 5,524,754 | 6/1996 | Hollingsworth | 206/320 |
| 5,676,223 | 10/1997 | Cunningham | 190/109 |
| 5,725,090 | 3/1998 | Vermillion et al. | 206/320 |
| 5,762,170 | 6/1998 | Shyr et al. | 190/109 |
| 5,808,865 | 9/1998 | Alves | 361/685 |

*Primary Examiner*—David T. Fidei
*Attorney, Agent, or Firm*—Edward J. Chalfie

[57] ABSTRACT

An improved carrying case for a laptop computer or other delicate instrument is disclosed. The improved computer carrying case allows access to the stored computer/instrument via more than one opening to permit use and operation of the instrument without requiring extensive unpacking, particularly during transit when there is an enhanced risk of damage to the stored computer/instrument. The case, further, may allow storage of peripheral devices, including those to be used with the stored computer. The case may also be used to simultaneously store catalogs, manuals and other papers, thus making it a versatile aid to mobile users.

19 Claims, 7 Drawing Sheets

MULTIPLE-ACCESS COMPUTER AND CATALOG CARRYING CASE

This application claims priority from the provisional application #60/083,734, filed on May 1, 1998 with the United States Patent Office.

BACKGROUND OF THE INVENTION

1. Field of the Invention

This invention relates to a carrying case for a laptop computer or an electronic instrument. More particularly, this invention relates to a computer and catalog carrying case which permits the owner to access and possibly even operate the computer stored in the case without extensive unpacking. The invention provides for securely carrying a computing instrument along with papers/catalogs and accessories while being able to access the instrument from more than one opening in the case for performing many tasks requiring the use of the instrument. This field includes computer storage cases designed for storing and carrying laptop computers, computer peripherals and electronic instruments. More broadly, the field includes storage cases such as suitcases and carry-on bags used in traveling.

2. Description of the Prior Art

The advent of computers, in particular the proliferation of laptops and ever more compact computers with increasing computing capacity has dramatically enhanced the utility of computers, not just in offices or homes, but in course of commuting, traveling or deliberately choosing a mobile office mode of functioning. There has been a proliferation of computer carrying cases to meet these needs. In particular, designs have been developed that provide for a plethora of pockets/compartments, security, and protection of the equipment being carried from shocks while being transported.

While concerns about protection of the delicate electronic components in computers, specially the precision mechanical moving parts such as those found in hard disks, have been addressed, at least in part, by the prior art, which includes designs allowing for shock absorbing features to protect a computer from rough handling in course of transportation, many problems remain in the efficient utilization of computers. Computers have become vital tools of modern commerce and industry and are useful not only as static machines to which the tasks are routed but as machines that go to the tasks as needed. The problems in expanding the use of computers are beyond mere concerns about their delicate and fragile nature.

These problems are over and above those addressed by the makers of delicate moving mechanical parts. For example, hard disks drives, usually using magnetic media, but also including optical memory means that may be read or written to using light, which is usually provided by, but not necessarily always, lasers, allow for 'parking' of delicate parts such as the magnetic heads or freezing the alignment of light paths to protect against damage and disruption from shocks.

Improvements in transportation technology and more robust designs of the fragile parts and even peripheral devices have ameliorated many of the concerns relating to damage resulting from mechanical shocks. This reduced concern has also been fueled by the spectacular technological advances that have resulted in a very high rate of obsolescence, and hence, rapid depreciation in the value of computers due to the introduction of new and improved models. On the other hand, rapid obsolescence increases the need for efficient utilization of existing computing instruments. The change in the patterns of use of computers and associated peripherals has resulted in generating new problems that have not been addressed in the prior art.

Currently, a computer in storage is a computer that is doing little more than depreciating at an alarming rate. Prior art has not addressed this aspect of the utilization of computers to make their use more convenient, efficient and economical. Not surprisingly, prior art does not reveal carrying cases that permit access to ports and use of an instrument while in transit without removal from its case. Nor does the prior art reveal computer carrying cases that would permit the computer to be conveniently removed from the case from more than one opening.

Additionally, it is desirable to have access to computers packed in carrying cases such that the entire case is not unpacked. If it should be possible to extricate a computer from a carrying case containing several other items without having to remove the entire case, it would be of great benefit to travelers, particularly air-travelers who have to contend with tightly packed overhead storage bins. These benefits are also not provided by the prior art.

OBJECTS AND SUMMARY OF THE INVENTION

This invention was disclosed in a provisional application #60/083,734 filed on May 1, 1998 which is incorporated herein by reference.

The invention described herein overcomes many new problems associated with the transportation and use of computers. The invention also meets modern needs by permitting better utilization of computing and other instruments, both in mobile use and in a office setting. The invention promotes efficiency, economy and productivity in the utilization of computers. Rapid obsolescence of these computers has increased the need for tools and means that permit the maximum utilization of the computers in keeping with the emerging modern lifestyles, transportation and other technologies and convenience. These objectives and needs are met by the invention disclosed here.

The present state of technology for the manufacturing of computers and peripheral devices permits production of devices that are capable of being used on the go. Such devices include CD-ROM drives, hard disk memory devices, floppy drives, optical memories, PCMCIA cards, SCSI extensions, power supplies, displays, keyboards, mice, joysticks, virtual reality add-ons, scanners, printers and the like as is known to one skilled in the art.

Transportation technology has improved as well. Many newer automobiles and buses feature improved suspensions that dramatically reduce shocks due to road imperfections. Modern airplanes often have connections for hooking up computers and related peripherals. Still, a storage case offers desirable protection from mechanical trauma from falling objects, dust, spills, or even sunlight in course of traveling.

However, there are several problems associated with the modern computing devices. Their operation by many users, who may not be extensively skilled, often requires help in the form of books, or online resources or stored help routines to ensure proper operation and servicing of the devices. Carrying such manuals, books and help sources requires carrying cases that would permit a spatially contiguous storage of such items with the computer to which the literature is related. This is a routine need because not all help literature is available in an electronic form. Furthermore, print media is indispensable for servicing equipment that breaks down which may make accessing electronic information difficult.

Many portable instruments, including laptop computers, are used by salespersons and service technicians who may need to carry spare manuals and literature for distribution to their customers. Thus, sturdy carrying cases that include space for such added load are desirable. Even more significantly, many such salespersons and technicians maintain records, and communicate via the computer with their customers, home office, family and friends/co-workers while on the go. Thus, they need the computing instrument to be accessible on the go while retaining the advantages of storing the instrument in a case to protect it from damage while retaining use of the stored instrument.

Furthermore, using many of the peripheral devices requires plugging a peripheral device into built in ports, i.e. specific sockets, in the computer/electronic device. Such ports may also be added in the form of another plug-in-device in a computer. Also, modern standards have introduced protocols known as 'plug-n-play' which allow for plugging in a peripheral device, on occasion without even having to electrically switch off the computing instrument/device, without the need for anything beyond loading the required software. Often, the software may be loaded in advance and a suitable peripheral device plugged in as needed. Some ports may support SCSI protocols that allow several peripheral devices to be connected to the same port. Efficient use of these possibilities requires access to the ports even when the computing instrument is still in the storage case.

The invention described herein solves these problems by permitting safe storage of the instrument/device while permitting access to its ports, and other parts as needed. Such access permits use of the instrument/device, with its desirable complement of peripherals selected by the user, but without incurring avoidable risks.

The invention envisages a carrying case that has more than one opening for accessing the interior. Since ports on many instruments/devices are on the back or the side, a side opening permits hooking up the devices desired by the user without requiring removal of the instrument from the case. Other stored material, including books, manuals, catalogs, tools etc. remain in place and do not have to be unpacked unnecessarily. Furthermore, some of the peripheral devices stored in the computer carrying case could be left connected to the computer while in storage while others may be added when needed. Importantly, if desired, an opening in the carrying case that provides access to the instrument/device may be locked or closed to prevent unauthorized or undesirable access by using closing means such as flaps, panels, zippers, hook-and-loop arrangements, buttons, clasps, locks, snaps, ribbons, sticky ends and the like as are known to one of ordinary skill in the art. Closing an opening, even partially, increases protection of the computer from scratches, dust, spills and the like in addition to enhanced security.

Additional features such as an attached trolley, retractable supports or wheels may be provided to further aid in moving the carrying case in situations where mechanical power may not be available and physical exertion undesirable. This is a significant advantage even with the dramatically reduced weight of modern computing devices particularly when the user is carrying accessories and literature. Of course, different users may need computer carrying cases having different sizes and designs to suit their needs. The schematic drawings included illustrate many of the features and details of the invention, including access from either the top or side or front.

The invention also permits a user to extricate a computing instrument from a carrying case that may contain several additional items without having to extensively move the carrying case. This feature is likely to be of great benefit to airline travelers who have to use tightly packed storage bins and find it inconvenient to access a computer that is packed in carrying case due to the need to remove the carrying case from the storage bin. The provision of multiple modes of accessing the computer also facilitates many ways for accessing and removing the computer thus reducing the likelihood of having to remove the entire carrying case from the storage bin.

Yet another objective of the invention described herein is to further increase the design possibilities for computer carrying case. Such increased possibilities can be ornamental and/or utilitarian.

BRIEF DESCRIPTIONS OF THE DRAWINGS

The invention can be understood with reference to the accompanying drawings, wherein like reference numerals in the three figures are employed to designate like components.

FIG. 5 illustrates the movement of an interior partition, in a computer case similar to the embodiment shown in FIG. 4, to permit access to a stored computer in the case from the front or the top.

DESCRIPTION OF THE PREFERRED EMBODIMENTS

Figure 1:
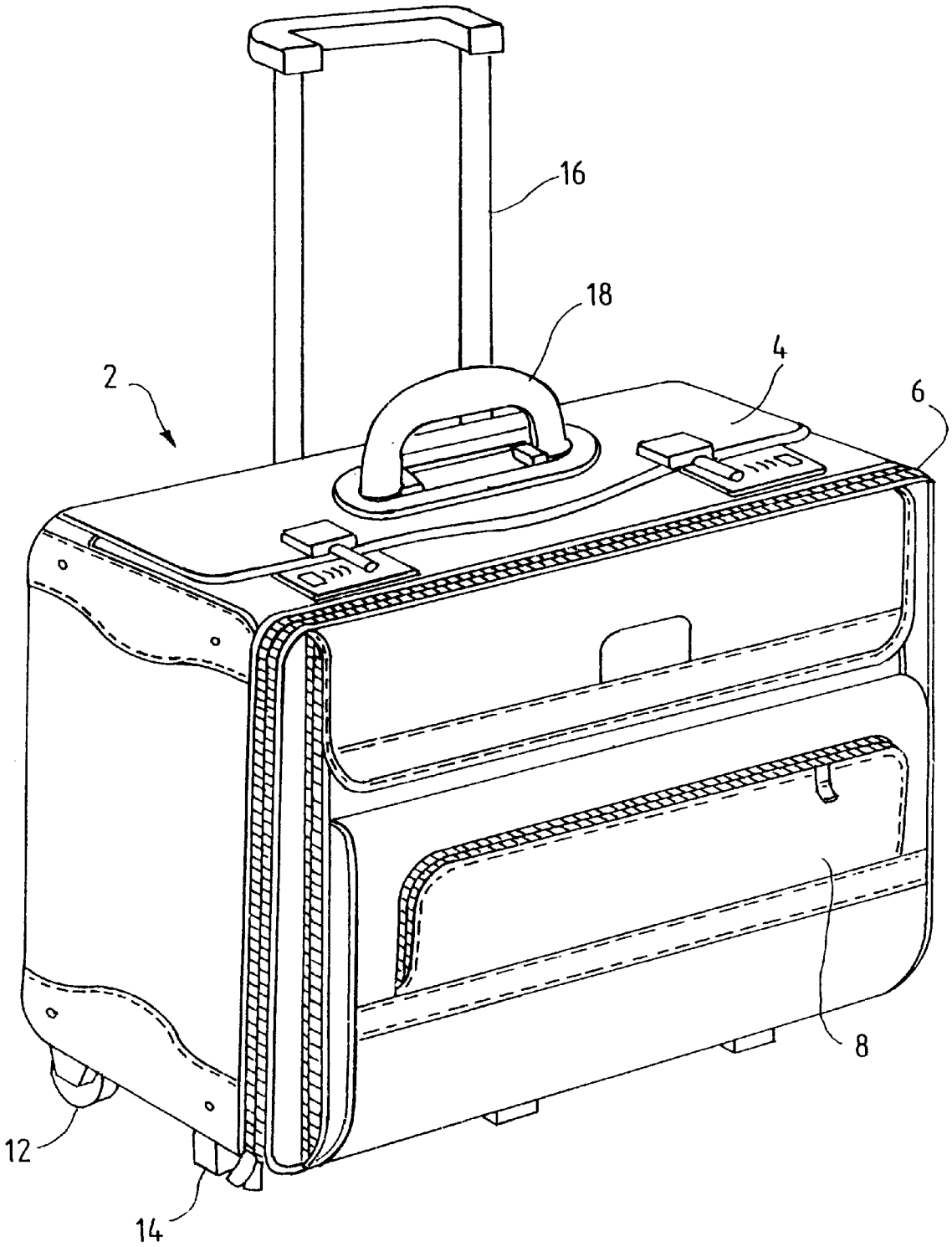
FIG. 1 shows an embodiment of the invention as a carrying case which has a top opening and another opening in the front panel. The front panel also shows a configuration of several long exterior storage compartments.

The invention can be understood in greater detail by referring to FIGS. 1–8. It should be noted that the panels/flaps shown in these figures need not be rigid and may be flap-like as well. The panels/flaps are intended to substantially close the opening. Of course, in some embodiments some openings may be left open. Furthermore the terms panel and flap are often used interchangeably and no restrictions should be inferred from such usage.

A computer case is defined by an interior or enclosure defined by surfaces substantially surrounding it. Articles to be stored, which include computers, are placed in the enclosure. Of course, more than one enclosure may be included within a case if internal walls or partitions are introduced. Access to the interior is via openings in the surfaces defining the interior of the case. Such openings may be defined by the means for closing them or by the surfaces in which the opening is located. While an opening is usually present in one surface it is possible to define an opening by more than one surface, for instance when an opening is formed by the junction of two or more surfaces which also function to define the outer boundaries of the enclosure. Such junctions may form corners, whether rounded or sharp.

It should be also noted that additionally compartments may be built into or provided in computer carrying cases. For the purpose of the description here compartments are treated as being different from the enclosure in so far compartments are expected to be used for storing books, peripheral devices, writing implements, tools and the like while a computer is likely to be placed in an enclosure, whether secured, i.e. substantially immobilized by fixture means, or somewhat loose. From a practical viewpoint, it is necessary to have at least one compartment in addition to an enclosure in a case.

In the preferred embodiments of the invention the openings for accessing the enclosures within the case are recloseable. Naturally, such closure may not necessarily be a complete but is envisaged as substantially closing the opening in conformity with the use of the computer carrying case as is known to one skilled in the art. Furthermore, the reclosable openings may be independent or dependent. An opening dependent on another opening is necessarily opened whenever the other opening is opened, e.g., if a single flap closes both openings. An opening is independent of another if it can be opened, or closed, regardless of the state of the other opening.

Furthermore the surfaces defining the enclosure need not be rigid and floppy material may be used without any loss of generality. The computer carrying case is then defined not by the shape of the surfaces surrounding its interior because the surfaces may be flexible, but rather by the topological configuration of the surface which is defined by the number of openings and the existence of a useful interior or enclosure defined by the possibly flexible surfaces. Such a description of shapes is well known to mathematicians as well as makers of containers. Thus, a typical plastic bag has one opening for access to an enclosure defined by the flexible walls of the plastic bag.

Any of the surfaces defining the enclosure inside the computer carrying case may be rigid or be defined by material attached to a substantially rigid frame. Such a frame need not define all of the surfaces but only some of the surfaces. This is an advantage in many situations where weight of the case is also a major concern. Rigid frames tend to be heavier and less amenable to stuffing the case into small spaces. In such situations some embodiments of the invention are more useful with only some of the surfaces being rigid or reinforced by a substantially rigid frame.

Figure 2:
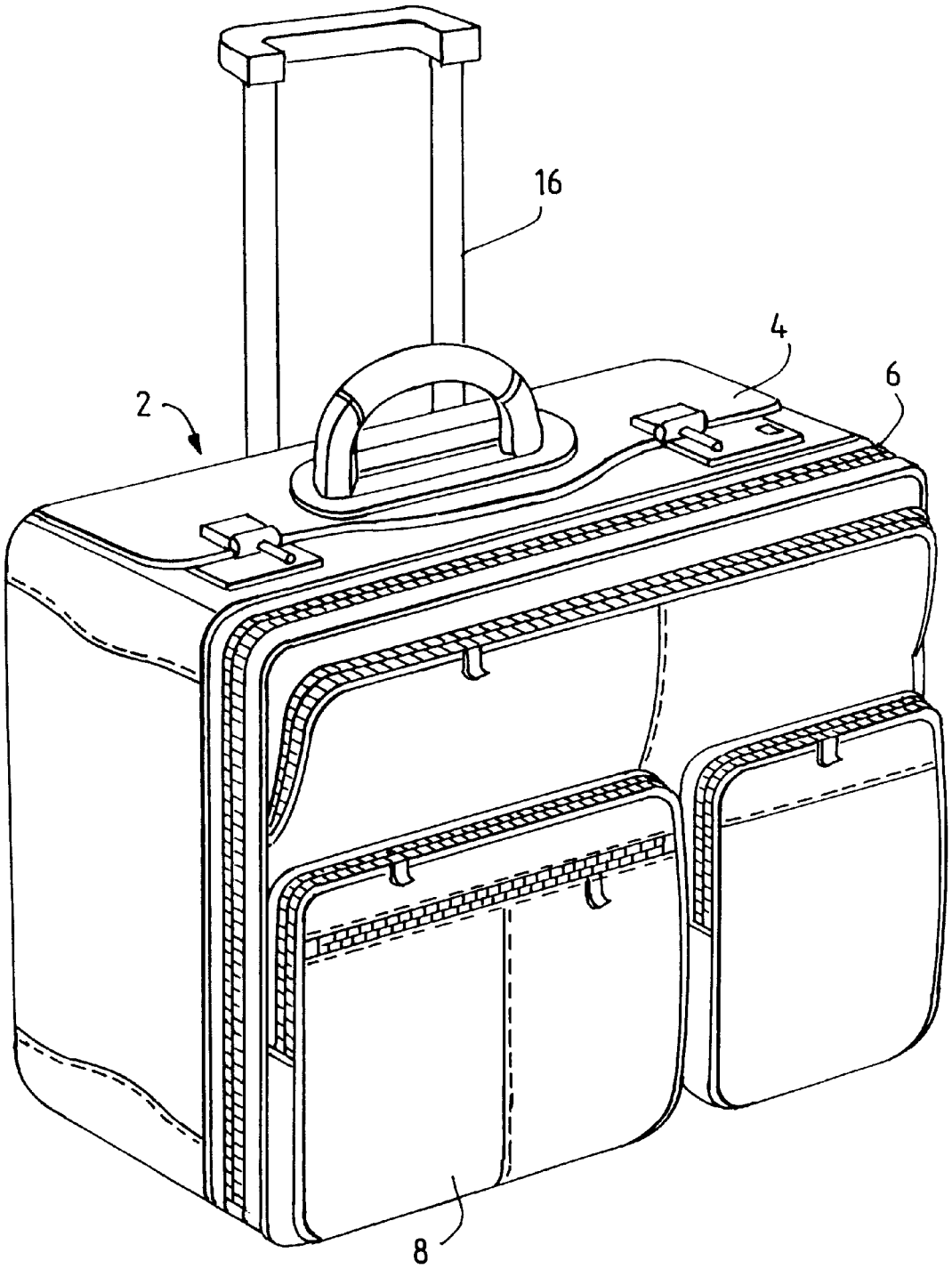
FIG. 2 shows another embodiment of the invention as a carrying case, similar to FIG. 1 except that the exterior storage compartments on the front panel are displayed in a different arrangement with more compartments.
Figure 3:
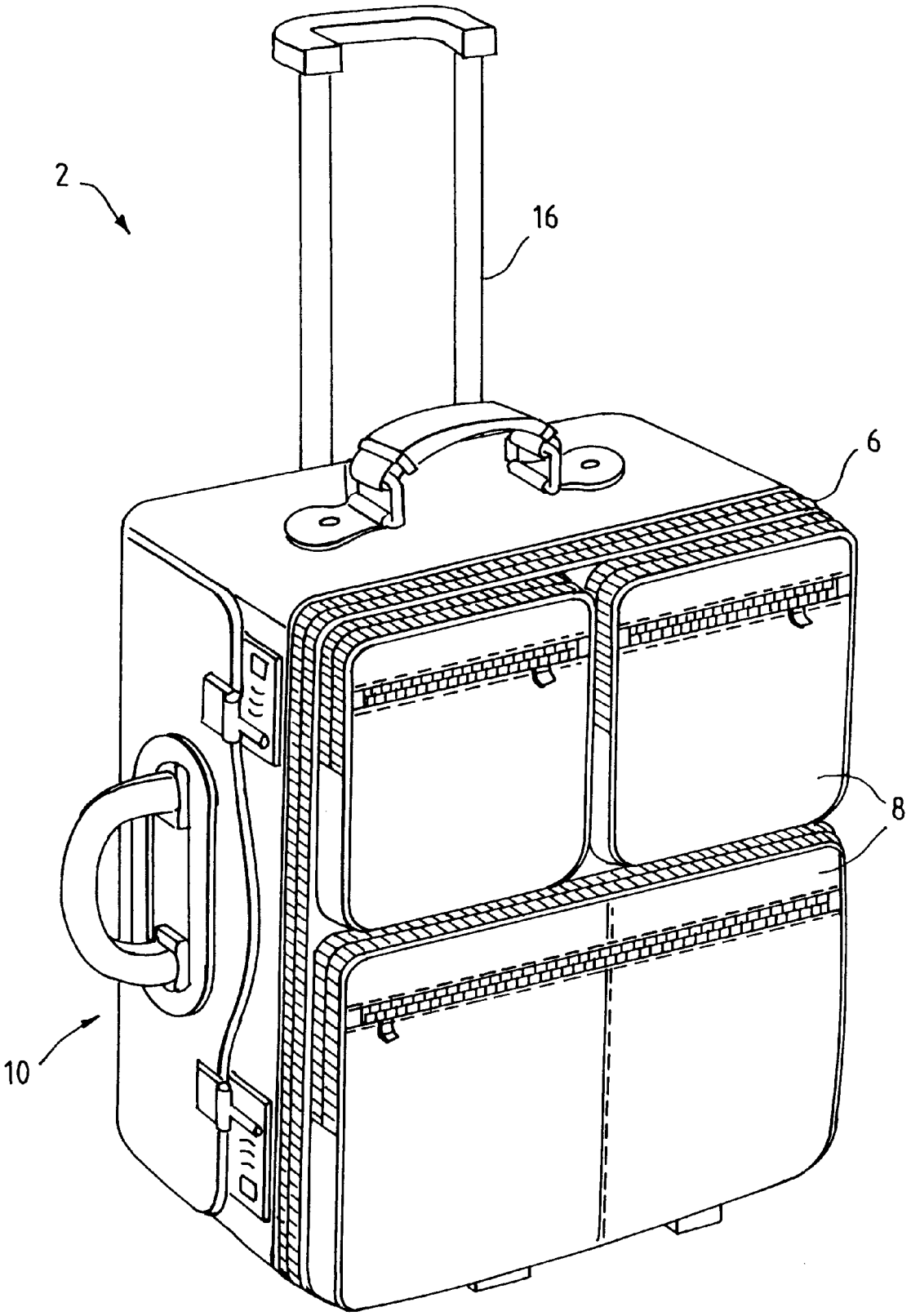
FIG. 3 depicts another embodiment of the invention as a carrying case with a side opening and a front opening. The front opening panel illustrates yet another arrangement of exterior compartments.

As shown in FIGS. 1 and 2, the carrying case 2 has an opening on the top 4 and another opening 6 on the on the front at the case 2. The front of the case 2 also has several storage compartments 8 built into the case that can be accessed without opening the case. FIGS. 2 and 3 illustrate additional variations in the arrangement of the compartments 8 on the exterior of the case 2. FIG. 3 also illustrates an opening 10 in the side of the case 2. This flexibility in the placing of recloseable openings is further illustrated in the schematic FIGS. 4–8. It should be noted that the broken lines in FIGS. 4–8 show features not essential to the particular design illustrated in the respective figure. Furthermore, there can be more than two openings in a case as well.

Access to the interior of the case 2 may be influenced not only by the placement of recloseable openings on the outside of the case 2, but by design features inside the case 2. Specifically, access to the entire interior of the case 2 may not be possible from a single opening. This flexibility also permits designs that provide internal compartments that are designed to securely and safely store computers and accessories and still provide access to components likely to be needed most without extensive unpacking of the case 2.

Additionally, case 2 would have means to aid in transporting it. Such means may include shoulder straps, one or more wheels 12, legs 14 for standing the case 2 and protecting its bottom surface from damage by keeping it off the ground, a retractable handle 16 for pulling the case 2, or a handle 18 primarily for lifting and carrying the case 2.

Figure 4:
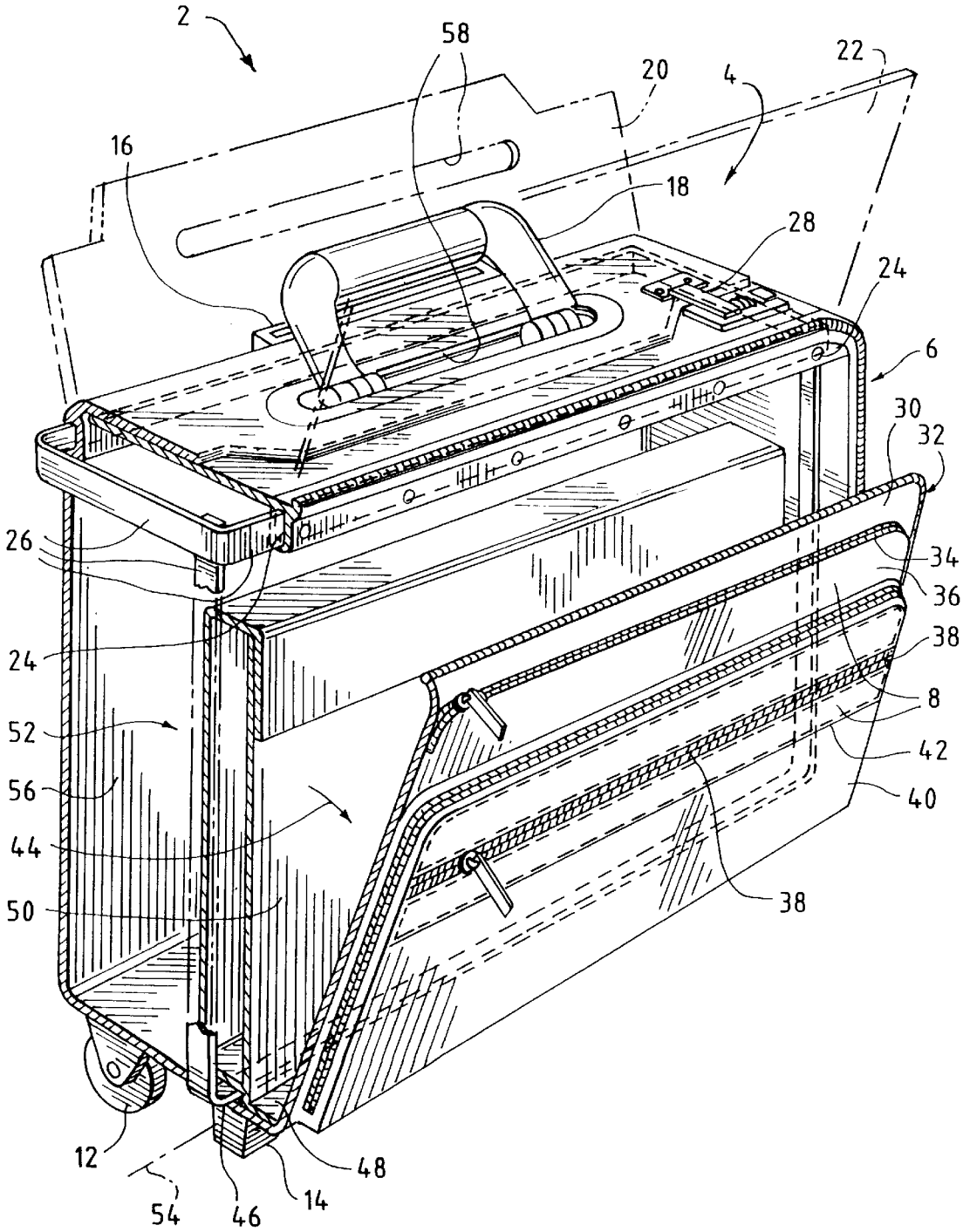
FIG. 4 illustrates a detailed drawing of an embodiment with another variation on providing multi-access to the interior of a case.

FIG. 4 illustrates the details of an embodiment based on the invention described herein. The computer carrying case 2 has a top opening 4, which can be closed by two top-flaps, a first top-flap 20 and a second top-flap 22. The top flap 22 is attached via flap attachment means 24 to a substantially rigid frame 26. The broken lines show the top flaps 20 and 22 in an open position for the opening 4 while the closed lines illustrate the closed position. The top-flaps 20 and 22 can also be secured by securing means 28 to close the recloseable opening 4. Flap attachment means may be rivets, stitching, hinges, zippers, hook-and-loop arrangements, nails, screws, glue, adhesive, and many other means as are known to one skilled in the art. Similarly, securing means could be latches, locks, ribbons, zippers, buttons, hook-and-loop arrangements, sticky surfaces and many other means known to one skilled in the art for substantially closing a recloseable openings.

The front opening 6 in the case 2 is accessed by moving the front-flap 30 which is secured to the case by the zipper 32. Needless to say, other means may be employed to close the front opening 6 as is known to one of skill in the art. Such means may include latches, locks, ribbons, buttons, hook-and-loop arrangements and many other means known to one skilled in the art. There could be several compartments 8 built into the outside of the case 2. In this embodiment, the front-flap has a zipper 34 to close a first pocket 36 outside of the case 2. In addition, zipper 38 closes a second pocket 40 on the outside of the case 2. There may be ornamental or functional stitching patterns 42 on the outer surface of the case as well.

Front-flap 30 can be moved as shown by the arrow 44. The front-flap 30 is attached to the front-bottom edge 46 of the substantially rigid frame 26 or the bottom-panel 48. The substantially rigid frame 26 need not be a single piece and may itself be assembled from components without any loss of generality. In addition, an interior partition 50 is also attached to the front-bottom edge 46 or the bottom-panel 48. The interior partition 50 may be moved as depicted by the arrow 52. Arrows 44 and 52 illustrate motion about an axis 54 which may be conveniently chosen to be substantially parallel to the front-bottom edge 46 of the substantially rigid frame 26. Needless to say, the motions illustrated by the arrows 44 and 52 may or may not have the same axis as a reference. The choice of axis 54, as illustrated, is for clarity only. The substantially rigid frame 26 is also attached, directly or indirectly, to side-panel 56.

The case 2 can be transported and handled with ease. The feet 14 allow the user to safely leave the case 2 upright without damaging the bottom panel 48. Wheels 12 permit the case 2 to be rolled or the grip/handle 18 may be used to carry it as desired. In the embodiment shown in FIG. 4, grip/handle 18 is attached to the flap/panel 22 which can be accessed, in the closed position of the flaps 20 and 22, via a slit 58.

The front-panel 30 has two outer-gussets, an outer-left gusset 60 and an outer-right gusset 62, further connecting the front-panel 30 to the side-panels 56. The outer-left gusset 60 and the outer-right gusset limit the extent of motion permitted to the front-panel 30 and help prevent stored objects from spilling out when the front-panel 30 is opened to allow access to the interior of the case 2 via the opening 6 on the front of the case 2.

Figure 5A:
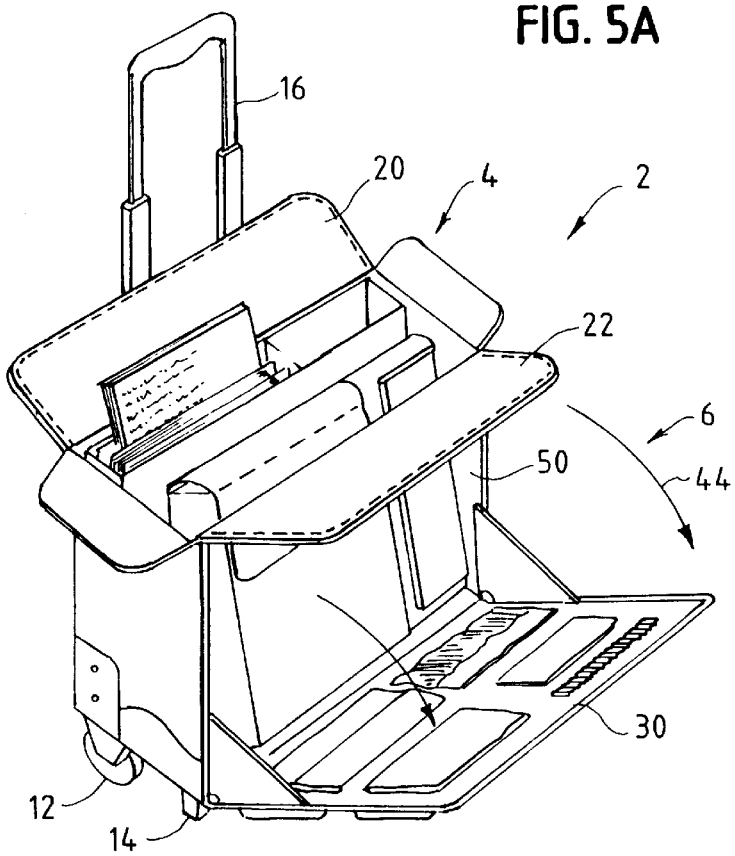
FIG. 5A shows the interior partition in its closed position and FIG. 5B shows the partition in its open position.

FIG. 5A shows the case 2 with an interior-partition 50 in its closed position. The interior partition 50 has compartments 64 built into it. These compartments 64 are inside the case 2 when the front-flap 30 is closed as is depicted in FIGS. 1–2. The interior partition 50 can be moved as shown by the arrow 52.

Figure 5B:
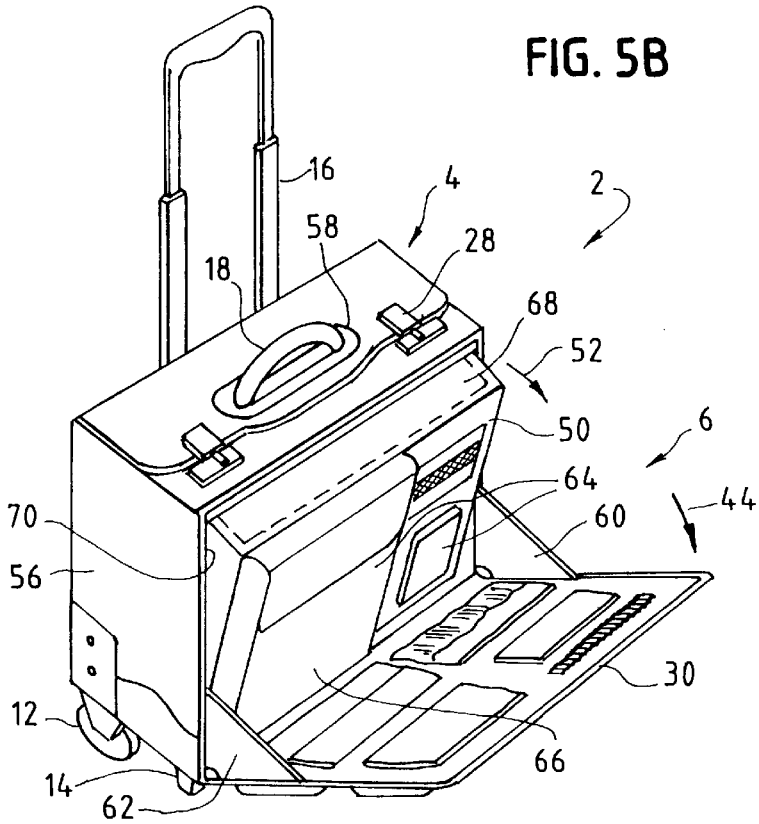

FIG. 5B shows the interior partition 50 in its open position. Thus the interior of the case 2 is divided into a first interior space 66 and a second interior space 68. The first interior space 66 is between the interior partition 50 and the front-flap 32. The second interior space 68 is between the interior partition 50 and the back-panel of the case 2. In this embodiment of the invention accessories, catalogues cellular phones and other objects of interest that may be needed independent of the computer may be stored in the first interior space 68. These can be accessed independently of objects stored in the second interior space 68.

The interior partition 50 needs to be moved into its open position shown in FIG. 5B to permit access to the objects stored in the second interior space 68 from the opening 6 on the front of the case 2. There is an inner-gusset 70 limiting the range of motion permitted to the inner-partition. Of course, this is only one of many designs possible for a multi-access computer carrying case taught by this invention. Thus, this detailed description should not be interpreted to be limiting the scope of the invention described here.

Notably, the top-opening 4 also allows access to the first interior space 66 and the second interior space 68 as is shown in FIG. 5A. In some designs, access to the first interior space 66 may be more limited via the top-opening 4 in the case 2 as compared to access to the second interior space 68 via the top-opening 4 in the computer case 2. Furthermore, the weight of the heavy load that can be carried in the case 2 can be transported easily by rolling the case 2 on wheels 12. FIGS. 5A and 5B illustrate the case 2 with a retractable handle 16 on the rear of the case to permit it to be rolled along using the wheels 12.

Figure 6:
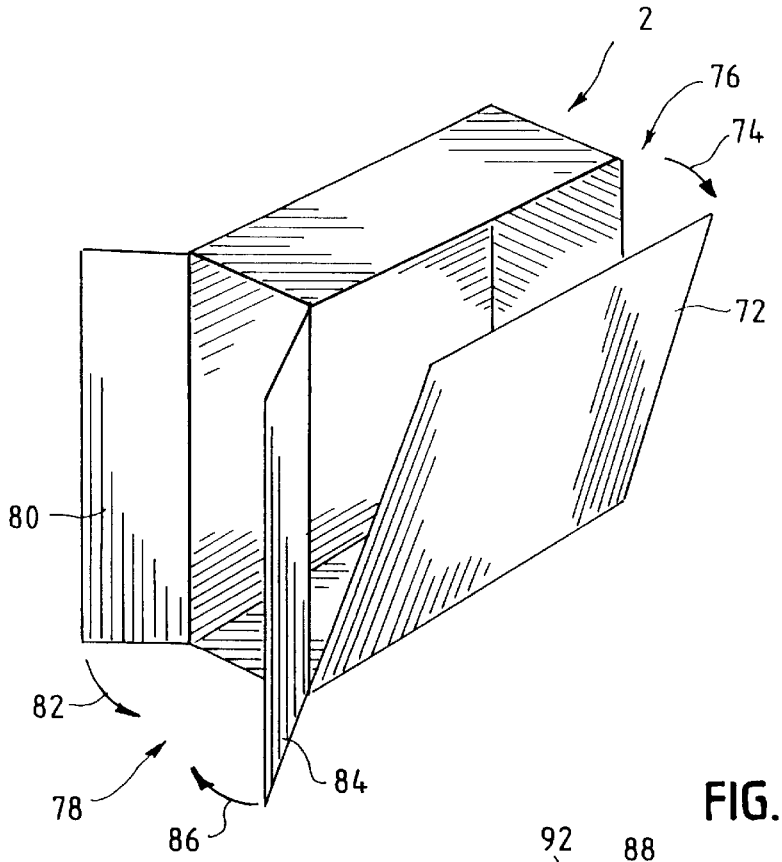
FIG. 6 illustrates a schematic of an opening defined by two rotatable panels while another side has an opening formed by a single rotatable panel.
Figure 7:
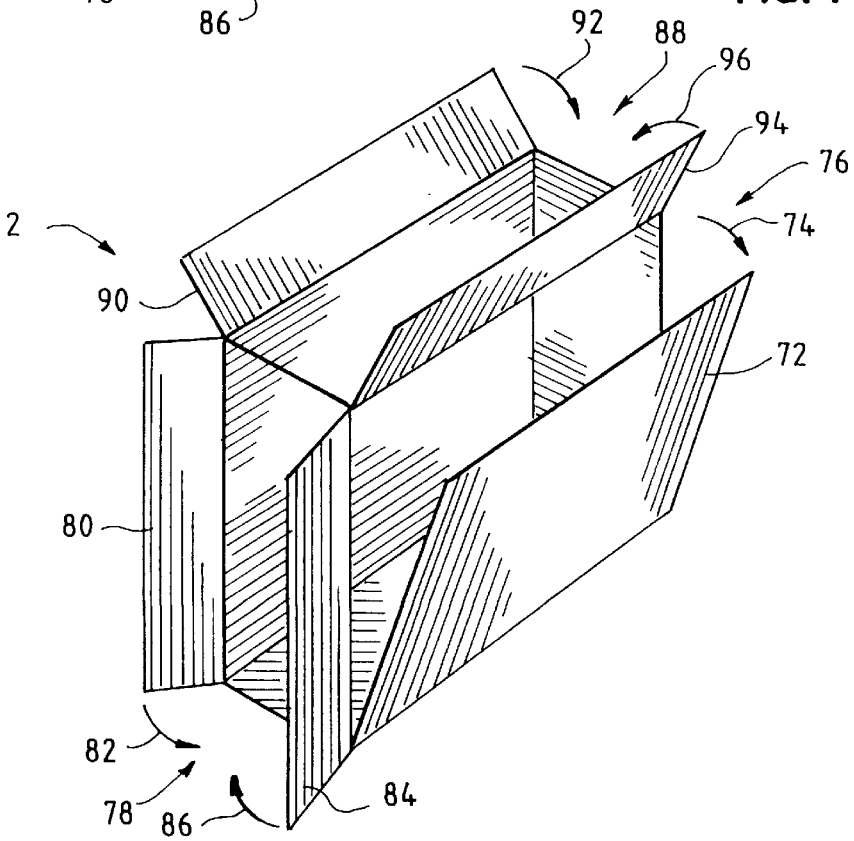
FIG. 7 illustrates a schematic of three different openings defined by rotatable panels.
Figure 8:
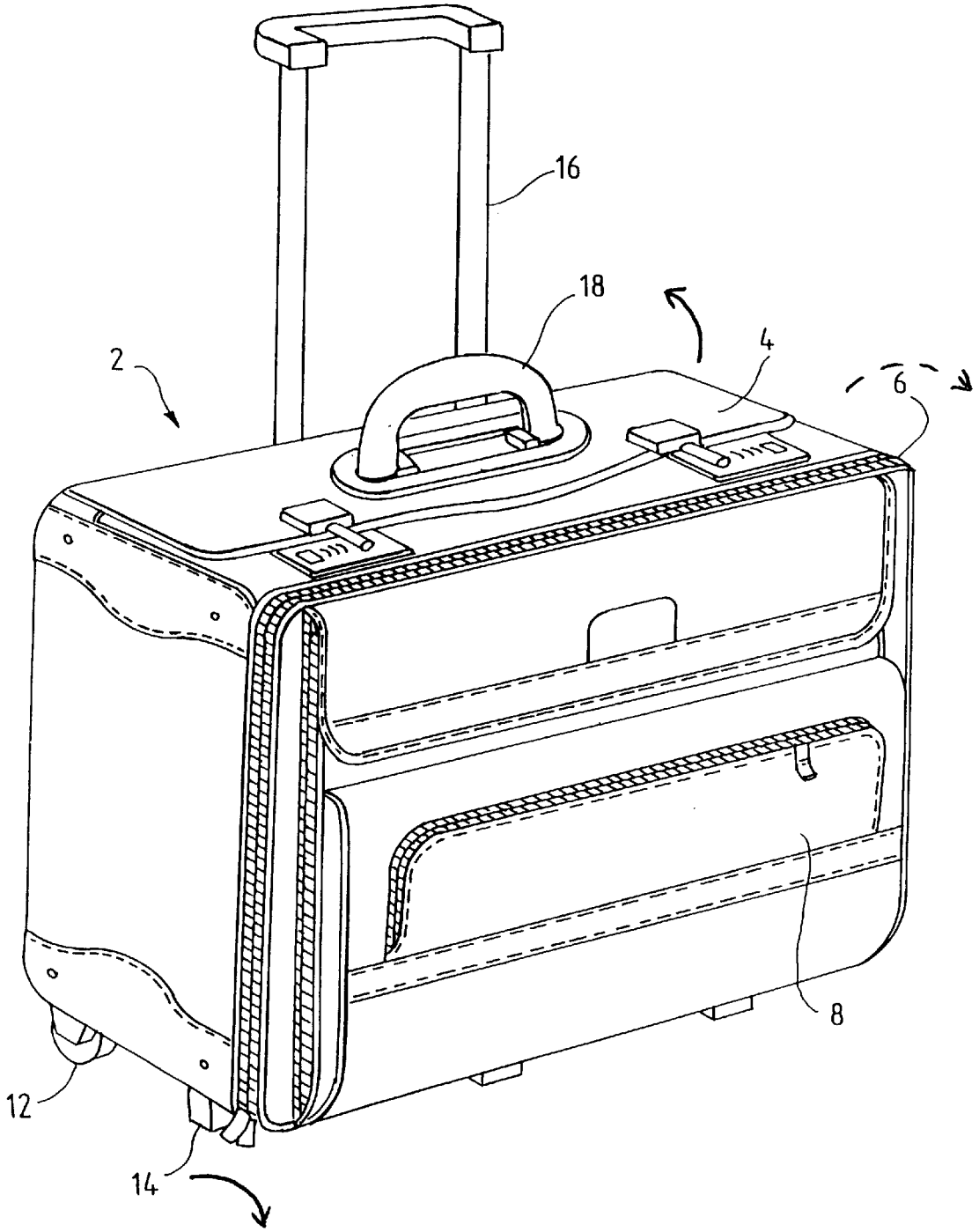
FIG. 8 illustrates a schematic of the present invention.

FIGS. 6–8 illustrate a variety of alternative designs for placing openings on the outside of case 2. It is evident that these designs are a small fraction of the possible designs for multi-access computer carrying cases. The number of possible designs is increased even further if the variations due to the placement of internal partitions and partial access to the interior are taken onto account. The provision of multiple openings in a computer carrying case, thus, has the interesting consequence of dramatically increasing the design possibilities. This may be understood easily by considering combinatorial arguments. In a six-sided object with only one opening there are six possible ways of providing an opening that is co-planar with a side of the object. If two of the sides are used to an the opening, that is to close the opening then the number of designs increases to the number of edges available, i.e. 12. If two openings are permitted in the object then there are six ways of choosing a first opening and 5 ways of choosing a second opening leading to 30 different possibilities. These may be increased further by additional openings or by considering openings defined by more than one side.

FIG. 6 illustrates a schematic design of a computer carrying case 2 with a front-flap 72 that can move as shown by arrow 74 to close an opening 76. This design schematic illustrates a side-opening 78 defined by two pivoting panels, a first panel 80 which pivots as shown by arrow 82, and a second panel 84 which is pivots as shown by the arrow 86.

FIG. 7 illustrates another schematic design of a computer carrying case 2 with three openings. The third opening 88 is closed by a panel 90 pivoting as indicated by arrow 92 and by a panel 94 which may be moved as shown by arrow 96. Of course, in these designs the number of panels used to close an opening is not limited to two and may be varied from one to any number without any loss in generality. Finally, an entire side of the case 2 need not be used to define an opening, and instead only part of a side may be defined by a panel. Any and all of these possibilities may be combined to further increase design possibilities for multi-access computer cases.

FIG. 8 illustrates a computer carrying case with the ornamental features, defined by one of the many possible embodiments of the invention, shown by solid lines and the disclaimed features illustrated by the use of broken lines.

The invention described here is expected to be manufactured using conventional techniques that include, but are not limited to, thermal bonding of material, stitching together of component parts, use of matching hook-and-loop arrangements, ribbons, zippers, staples, rivets or the use adhesives as attachment means. In addition, a substantially stiff frame may be provided to give the computer carrying case a defined structure although, alternatively, stiff side panels may also be used. Naturally, all designs need not be stiff and in many instances a floppy design may be desirable for reasons of utility or aesthetics.

While the improvements in the modern technology have dramatically improved the robustness of electronic equipment, it is preferable to use shock-absorbing-impact-resistant material. Such padding material may be placed inside the computer carrying case. A preferred embodiment may have such material integral with the material used to make the panels though it is also possible to provide such material either loose or bonded to the computer carrying case using attachment means which include glue, hook-and-loop structures, snaps, casings into which such material may be slipped and the like as is known to one of ordinary skill in the art.

The panels and the sides may be made with nylon, plastics, polymer based materials, leather, canvas, cloth, paper, wood and the like including combinations thereof. These may be reinforced with cardboard, plastic, wood or other stiffening agents as is known in the art. The panels may be given a soft cushiony feel. The attachment of storage compartments to the computer carrying case allows for facile storage of papers, literature, books, tools, peripheral devices and portable storage media such as compact discs, tapes, cassettes, floppy disks of various storage capacities and the like.

Shoulder straps and/or molded shoulder-engaging member for comfortably carrying the computer carrying case may be provided. Such a computer carrying case could easily be carried aboard an airplane and be stowed in an overboard bin. If needed, the computer carrying case could be pulled down and the user could use it on his lap without having to unpack the entire case. Some of the peripherals could even be left connected while in storage if the peripherals were stored in the computer carrying case itself. Other peripherals could be connected as needed via the side openings provided. Alternatively, a frame with wheels may be more convenient for users such as salespersons who have to carry a lot of additional material. Of course, some peripherals could be left connected in storage if the particular design, of the computer, the peripherals and the particular computer case, permits.

A computer stored in the computer carrying case may, in principle, be operated without being removed from the computer carrying case. This may be managed by connecting input and output devices, and possibly even a power source via the ports and sockets accessible through the openings in the panels. Many users may find it convenient to use the built in battery in many portable or laptop computers. Preferably, for reasons of efficient cooling and access to the output display device which is usually a part of current laptop computers, it may be necessary to use a large opening. Such an opening is covered by panel 25 in FIGS. 1–3, and is closed using the zipper 35 in FIGS. 1–3. Of course, alternative closing means are possible as is known to one of ordinary skill in the art. Additional openings in some of the sides may provide access to the ports and sockets as needed.

The peripheral devices, including those meant to be used to be used with the computer, can be stored in storage compartments provided inside the computer carrying case by providing additional walls to define such storage space or stored in the compartments 30, as illustrated in FIGS. 1–3, provided outside the computer carrying case. Thus, the interior is not required to consist of a single compartment.

While sudden shocks may be avoided without undue effort on part of the user, the risk of a loose fitting computer or electronic equipment jarring against the walls of the computer carrying case can be reduced by the use of fixture means. Reducing such a risk is often a concern since even gentle motions setting the loose fitting electronic into motion relative to the carrying case may result in sudden stops because the electronic equipment may continue to move in the same direction while the case is moving in the opposite direction. Such damage is often encountered, in dramatic fashion, with loose cargo in the hold of a ship. Thus, motion of the stored computer in phase with the motion of the transportation mode, whether a car, bus, airplane, ship, boat, walking or swimming and the like may be preferable to relatively uncoupled (to the transportation mode) motion. Suitable fixture means include, but are not limited to, slots for legs, if any, friction providing surfaces, curved surface to make relative motion difficult, hook and loop mating arrangements between the electronic equipment and the computer case, frames that can fit to the size of the equipment and minimize uncontrolled motion.

Such fixture means may be bonded to the computer case by the use of attachment means. In addition, an adjustable frame that can adjusted to hold the electronic equipment and may also be adjusted, in addition, to fit the enclosure in the computer case may need no attachment means because a tight fit of the frame against the walls of the computer case would be sufficient to provide sufficient grip.

FIGS. 6–7 also illustrate the variety of ornamental variations that can be introduced in producing an embodiment of the invention. Combinations of the features can be used to produce an even greater array of design variations that are compatible with the functional features of the invention. In the event ornamental features are illustrated in the figures, broken lines show features not intended to be an element in the design/pattern illustrated in the figure.

It should be noted that the use of any of the terms computer, laptop computer, electronic equipment, peripheral devices and the like is not meant to exclude other such members unless the context and usage so requires. In particular, when a feature is described that would accommodate more than one of such member then they should be treated as being interchangeable. The term computer is a rather broad term that refers to, in modern usage, to electronic machines that can be programmed to perform a variety specific tasks. Most modern computers are designed around microprocessors with additional memory of varying speeds added. However, some of the modern computers are designed for very specific applications and may not be quite as flexible in their suitability for programming. All are intended to be included for the purpose of this description of the invention.

The invention and its embodiments described herein are subject to many variations in both the method of construction and appearance as is well known to one skilled in the art. Nothing in the description given here is intended to or should be construed to not include such variations within the scope of the invention. The description of the embodiments are intended to be illustrative only and should not be taken to define limitations on the invention.

I claim:

1. A carrying case having a base, sidewalls, and a top which is openable, a first one of said sidewalls being pivotally secured to said base, a divider panel pivotally secured to said base within said carrying case, said divider panel being generally parallel to said first one of said sidewalls and dividing said carrying case into at least first and second compartments, with said first compartment being located between said first one of said sidewalls and said divider panel, said first and second compartments being accessible through said openable top, said first compartment being accessible by pivoting the top of said first one of said sidewalls away from said carrying case, and thereafter said second compartment also being accessible by pivoting the top of said divider panel away from said carrying case, whereby access may be had to material in said at least first and second compartments through both the openable top and by pivotally opening said first one of said sidewalls and said divider panel.

2. The carrying case of claim 1, wherein one or more storage pockets are provided on said first one of said sidewalls.

3. The carrying case of claim 2, wherein said one or more storage pockets are provided on an outer surface of said first one of said sidewalls.

4. The carrying case of claim 1, wherein one or more storage pockets are provided on said divider panel.

5. The carrying case of claim 4, wherein said one or more storage pockets are provided on the surface of said divider panel facing said first storage compartment.

6. The carrying case of claim 5, wherein one of said one or more storage pockets is adapted to receive and store a laptop computer.

7. The carrying case of claim 6, wherein said storage pocket adapted to receive and store a laptop computer is an envelope having an opening flap at the top end of said divider panel, whereby said flap may be opened to remove the laptop computer from the envelope through the openable top.

8. The carrying case of claim 1, wherein pivoting restraints are provided between said carrying case and said first on of said sidewalls to limit the pivoting of the top of said first one of said sidewalls away from said carrying case.

9. The carrying case of claim 1, wherein pivoting restraints are provided between said carrying case and said divider panel to limit the pivoting of the top of said divider panel away from said carrying case.

10. The carrying case of claim 1, having a shorter pair and a longer pair of parallel sidewalls, so as to form a rectangular carrying case, wherein said first one of said sidewalls is one of said longer pair of parallel sidewalls.

11. A carrying case having a generally rectangular configuration with six sides, a first of said sides being pivotally secured to an adjacent second of said sides, a third of said sides which is opposite said second side is openable, a divider panel pivotally secured to said second side, said divider panel being generally parallel to said first one of said sides and dividing said carrying case into at least first and second compartments, with said first compartment being located between said first one of said sides and said divider panel, and said second compartment being located between said divider panel and a fourth of said sides which is opposite said first side, said first and second compartments being accessible through said openable third of said sides, said first compartment being accessible by pivoting the top of said first one of said sides away from said carrying case, and thereafter said second compartment also being accessible by pivoting the top of said divider panel away from said carrying case, whereby access may be had to material in said at least first and second compartments through both the openable third of said sides and by pivotally opening said first one of said sides and said divider panel.

12. The carrying case of claim 11, wherein one or more storage pockets are provided on said first one of said sides.

13. The carrying case of claim 12, wherein said one or more storage pockets are provided on an outer surface of said first one of said sides.

14. The carrying case of claim 11, wherein one or more storage pockets are provided on said divider panel.

15. The carrying case of claim 14, wherein said one or more storage pockets are provided on the surface of said divider panel facing said first storage compartment.

16. The carrying case of claim 15, wherein one of said one or more storage pockets is adapted to receive and store a laptop computer.

17. The carrying case of claim 16, wherein said storage pocket adapted to receive and store a laptop computer is an envelope having an opening flap at the top end of said divider panel, whereby said flap may be opened to remove the laptop computer from the envelope through the openable third of said sides.

18. The carrying case of claim 11, wherein pivoting restraints are provided between said carrying case and said first on of said sidewalls to limit the pivoting of the top of said first one of said sides away from said carrying case.

19. The carrying case of claim 11, wherein pivoting restraints are provided between said carrying case and said divider panel to limit the pivoting of the top of said divider panel away from said carrying case.

* * * * *